US005890232A

United States Patent [19]

Park

[11] Patent Number: 5,890,232

[45] Date of Patent: Apr. 6, 1999

[54] HELMET WITH AN AIR CUSHION BUFFER

[76] Inventor: Nam-Tae Park, 1102-Ho, 2-Dong, Sang-a A.P.T., 4-13, 5-Ga, Dangsan-Dong, Youngdeungpo-Ku, Seoul, Rep. of Korea

[21] Appl. No.: 977,043

[22] Filed: Nov. 25, 1997

[51] Int. Cl.[6] ..... A42B 3/10

[52] U.S. Cl. ..... 2/413; 2/421

[58] Field of Search ..... 2/413, 414, 410, 2/411, 425, 421, 423

[56] References Cited

U.S. PATENT DOCUMENTS

| | | | |
|---|---|---|---|
| 3,462,763 | 8/1969 | Schneider et al. | 2/413 |
| 3,668,704 | 6/1972 | Conroy et al. | 2/413 |
| 3,761,959 | 10/1973 | Dunning | 2/413 |
| 3,849,801 | 11/1974 | Holt et al. | 2/413 |
| 3,906,546 | 9/1975 | Gooding | 2/6.6 |
| 3,994,022 | 11/1976 | Villari et al. | 2/413 |
| 4,483,021 | 11/1984 | McCall . | |
| 4,778,638 | 10/1988 | White . | |
| 4,901,488 | 2/1990 | Murota et al. . | |
| 4,908,877 | 3/1990 | White . | |
| 5,003,631 | 4/1991 | Richardson | 2/6 |
| 5,014,365 | 5/1991 | Schulz | 2/412 |
| 5,083,320 | 1/1992 | Halstead | 2/413 |
| 5,263,203 | 11/1993 | Kraemer et al. | 2/413 |

FOREIGN PATENT DOCUMENTS

| | | | |
|---|---|---|---|
| 0473857 | 3/1992 | European Pat. Off. . | |
| 2726595 | 12/1978 | Germany | 2/413 |
| 871235 | 6/1987 | Rep. of Korea . | |
| 92202 | 1/1992 | Rep. of Korea . | |
| 928948 | 12/1992 | Rep. of Korea . | |
| 957642 | 7/1995 | Rep. of Korea . | |
| 568033 | 10/1975 | Switzerland | 2/413 |
| 947772 | 1/1964 | United Kingdom | 2/413 |

*Primary Examiner*—Michael A. Neas
*Attorney, Agent, or Firm*—Barbara A. Fisher

[57] ABSTRACT

A helmet with a rigid shell includes: an air buffer made of soft foam having a plurality of hollow cells, which is attached to the rigid shell; an air ear guard having a hollow chamber; and a pump having an exhaust port for inflating and deflating the air buffer and the air ear guard to adjust the size of the helmet to a user's head.

4 Claims, 4 Drawing Sheets

HELMET WITH AN AIR CUSHION BUFFER

BACKGROUND OF THE INVENTION

1. Field of the Invention

The present invention relates to a helmet with a buffer and more particularly to a helmet with an air cushion buffer which may be adjusted by controlling the air pressure.

2. Discussion of Related Art

Generally, a conventional buffer attached to the inner surface of a helmet is made from foam resin and destined to reduce impact. The buffer is covered with a fabric liner for a smooth ventilation and stable settling on the head. A strap is used to secure the helmet to a user's head. An example of such a helmet is shown in Korean utility model publication number 928948. When wearing the helmet, a user has to adjust the fabric liner to his/her head. It is also troublesome to wash the fabric liner.

It is known in the prior art to provide helmets and buffer parts of different sizes and shapes to match a variety of head shapes and sizes. The fabric liners of different sizes should be attached inside the helmets according to the shapes and sizes of users' heads. Consequently, the process of manufacture is complicated, so the cost of production increases. When wearing the helmet, a user must adjust the fabric liner to his/her head. It is also troublesome to wash the fabric liner.

The safety cap shown in Korean utility model publication number 92-202 includes air cells surrounded by material with flexibility in order to provide the cap with thermal insulation and buoyancy properties. The safety cap can be utilized as a fireproof cap or a cap used under water by adjusting the air in the air cells. The safety cap is portable after deflation. However, this portable safety cap is may be easily damaged by an impact because its shell is made of soft material. It is also difficult to maintain the shape of the cap because of its structure. Therefore, this cap can not be used as a safety helmet when operating a motorcycle or working on a construction site.

SUMMARY OF THE INVENTION

Accordingly, there is a need to develop an improved helmet that substantially obviates one or more of the limitations and disadvantages of the related art.

An object of the present invention is to provide a helmet with a buffer which is formed as an air cushion with hollow cells in order to enable a user to adjust the helmet on his head, regardless of head shape and size, by controlling the pressure of the air in the cells.

Another object of the present invention is to provide a helmet with an air cushion buffer which serves both as a conventional buffer and as a fabric liner.

Still another objective of the present invention is to provide a helmet with a buffer wherein the inner surface of the buffer which contacts with a user's head includes a ventilation means for evaporating sweat from the head.

Additional features and advantages of the invention are set forth in the description which follows, and in part will be apparent from the description, or may be learned by practice of the invention. The objectives and other advantages of the invention will be realized and attained by the embodiments as illustrated in the written description and claims hereof, as well as the appended drawings.

In accordance with the preferred embodiment of the present invention, a helmet having a rigid outer shell includes a detachable air cushion buffer made of rubber material, such as soft foam resin. The body of the buffer includes a plurality of interconnected hollow cells formed between its inner and outer walls, the inner wall being in contact with a user's head and the outer wall contacting with the inner surface of the helmet shell. The shape of the buffer body corresponds to the shape of the rigid shell of the helmet, and the buffer is secured inside the shell by snap fasteners or hook and loop tape fasteners (Velcro), the outer wall of the buffer being fastened to the inner surface of the shell of the helmet. The air buffer further includes inflating and deflating means, such as a pump with an exhaust port and a supply tube, for supplying compressed air and controlling the air in the buffer, thus making it possible to adjust the helmet to fit a user, preventing it from shifting or falling off the user's head. A detachable hollow chin strap can be filled with air using the inflating means to protect the chin. Also an air ear guard may be attached inside the outer helmet shell.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the present invention and are incorporated in and constitute a part of this specification, illustrate the preferred embodiments of the invention that together with the description serve to explain the principles of the invention.

DETAILED DESCRIPTION OF PREFERRED EMBODIMENTS

Reference will now be made in detail to the preferred embodiments of the present invention, examples of which are illustrated in the accompanying drawings.

Figure 1:
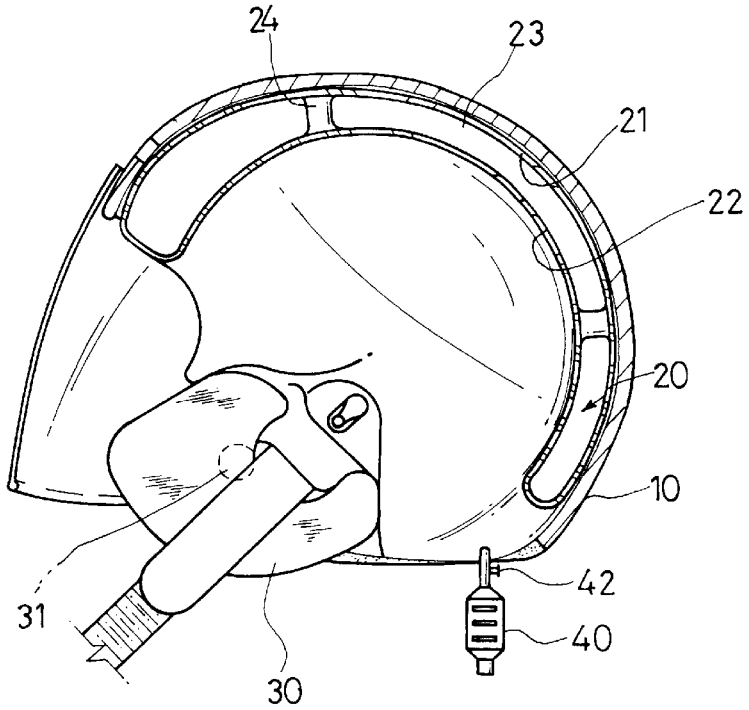
FIG. 1 is a cross-section of the first preferred embodiment of the present invention.
Figure 2:
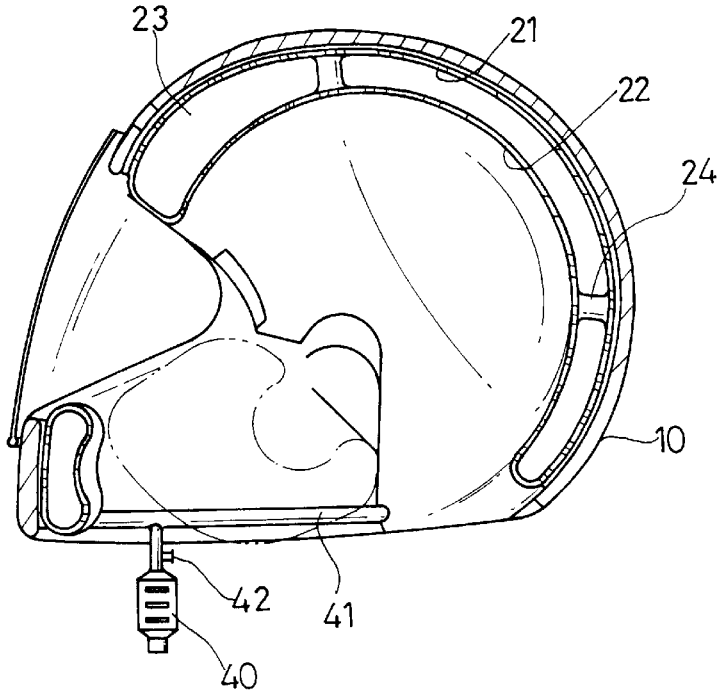
FIG. 2 is a cross-section of another preferred embodiment of the present invention.

Referring to FIG. 1, a helmet with a rigid outer shell and an air cushion buffer in accordance with the first embodiment is illustrated. The shell 10 is made of a high strength resin fiberglass composite as in prior art. The air buffer 20 and the air ear guard 30 are installed inside the outer shell 10. The outer and inner walls 21 and 22 of the air buffer 20 form hollow cells 23 of uniform width. The air ear guard 30 is also provided with a hollow chamber formed by its walls. A coupling bar 24 is formed in the air buffer 20 to prevent the air cell from swelling as the cell is inflated. The sound detection hole 31, which functions as a coupling bar, is formed in the air ear guard 30 to enable a user to hear any sound. A helmet having a air strap 50 is shown in FIG. 2. The air hose 41 connects pump 40, including exhaust port 42, to the air buffer 20 and the air ear guard 30 for inflating and deflating them. By supplying the compressed air to the air buffer 20, the air buffer 20 can be inflated quickly.

Figure 3:
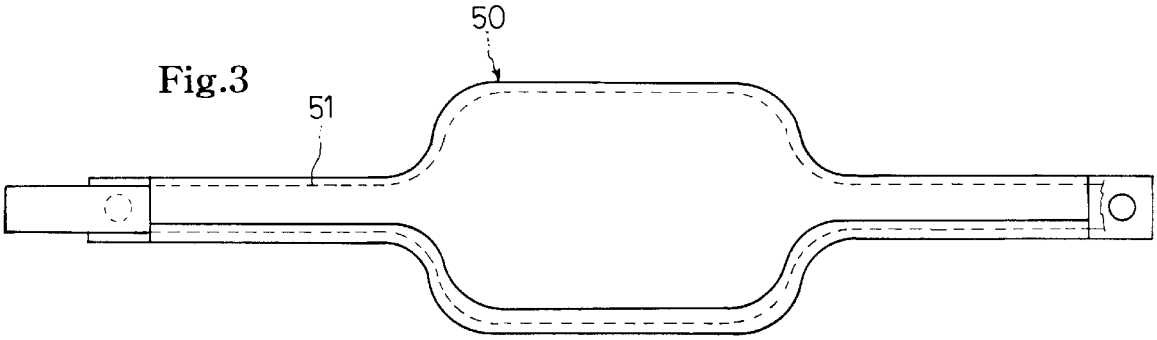
FIG. 3 is a front plane view of the air chin strap of the present invention.

FIG. 3 illustrates a chin strap that may be utilized depending on the configuration of a helmet. The air chin strap 50, which has a conventional shape, contains vent ports 51 on both ends, which are connected to the air buffer 20 via the air hose 41, so that the air can be supplied to the air chin strap 50.

A user can put on the helmet of the present invention after deflating the air buffer 20 using the exhaust port 42 of the pump 40 and releasing some of the air in order to easily adjust the helmet to his/her head. Then, a user can make the air buffer 20 comfortably fit his/her head by inflating the air buffer 20 by operating pump with his/her hand. The air buffer 20 swells due to the compressed air supplied by the pump 40 through the air hose 41 till the helmet snugly fits the user's head. The air ear guard 30 and/or the air chin strap 50 are supplied with air the same way as the air buffer 20 in order to closely fit the user's ears and chin.

The air buffer 20 can be adjusted to the size of a user's head. For example, when a user's head is small, the user can swell air buffer 20 to make the helmet fit his/her head by increasing the air supply from the pump. When a user's head is large, the user can reduce the air pressure in the air buffer 20 to make a well-fitted helmet. So the user can conveniently adjust the fit of the helmet while wearing it. This invention also eliminates the troublesome fabric liner which usually is attached inside the helmet and should be adjusted to the size of a user's head.

Since the helmet is fixed on a user's head by dictation of the air buffer 20, the user can get a well-fitted helmet regardless of the head shape and size, that solves the prior art problem of manufacturing the buffer and the liner in a variety of sizes to fit different head shapes.

Since the air from the buffer 20 and ear guard 30 can be exhausted through exhaust port 42 of pump 40, the user can easily remove the helmet of the present invention. Additionally, this invention is very effective in protecting the user's head from impact because the air cushion of the air buffer 20, the air ear guard 30, and the air chin strap 50 absorb the shock.

Figure 7A:
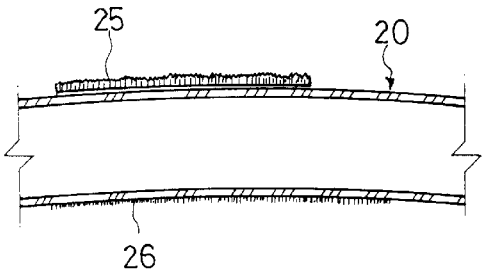
FIGS. 7A and 7B are detailed cross-sectional views of the air buffer of the first embodiment.
Figure 7B:
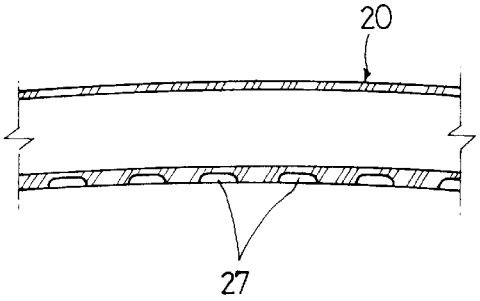

A soft fur lining 26 may be attached to the inner wall 22 of the air buffer 20 and the air ear guard 30 in contact with the user's head, as shown in FIG. 7A, for a smooth feel, and to form the ventilation channels 27 in order to evaporate sweat from a user's head, as shown in FIG. 7B.

The fasteners 25 securing the air buffer 20 to the helmet shell 10 are attached to the outer wall of the air buffer 20, as shown in FIG. 7A, and to the inner side of the outer shell 10 (not shown). They are detachable when necessary. For this purpose, a hook and loop fastener tape or snap fasteners can be utilized. As shown in FIG. 7A, using the hook and loop fastening tape 25, the air buffer can be easily attached to and removed from the helmet shell 10. The hook and loop tape can be replaced when damaged, so the helmet is economical because it is usable for a long time.

Figure 11:
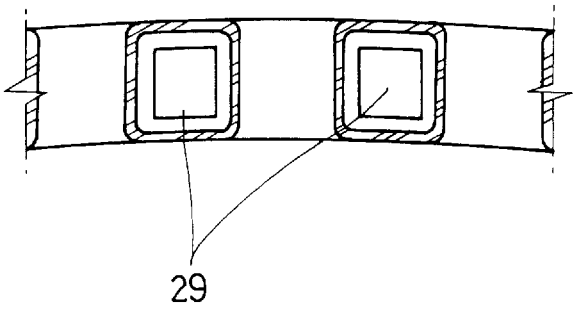
FIG. 11 is a sectional view illustrating an air cell with the inserted buffering material.

The buffering material 29, such as a sponge, which has buffer effect and is porous, may be inserted into the hollow portion of the cell 23, as shown in FIG. 11. The air buffer 20 can be inflated quickly due to the bulk of the buffer material 29. When exhausting the air from the air buffer 20 while the helmet is not in use, the buffering material 29 in hollow cells 23 prevents the inner wall 22 from wrinkling, thus preventing damage to the fur liner 26.

Figure 4:
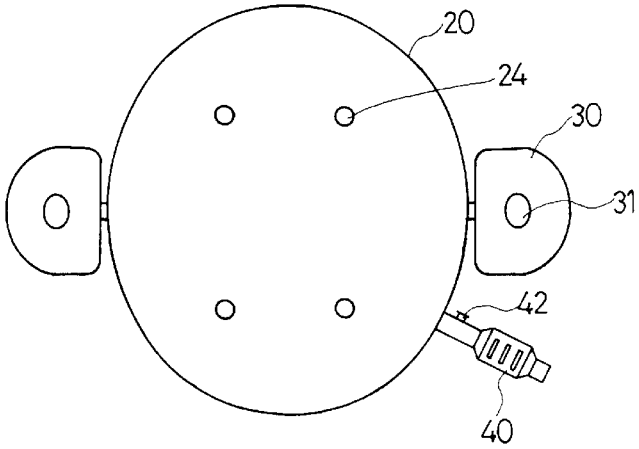
FIG. 4 is a plane view of the first preferred embodiment of the present invention.
Figure 5:
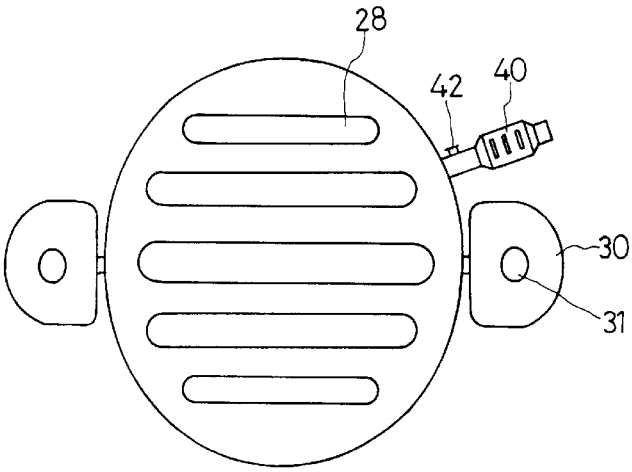
FIG. 5 is a plane view of the second preferred embodiment of the present invention.
Figure 8:
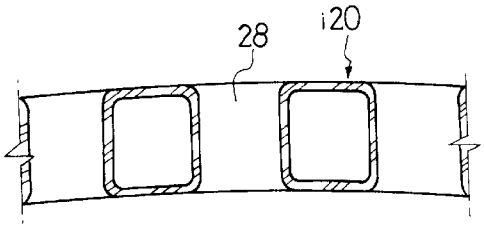
FIG. 8 is a detailed cross-sectional view of the second preferred embodiment.

Another embodiment is shown in FIG. 5 and FIG. 8, where the banana shaped cells of the air buffer 20 are separated by uniform partitions 28. The cells are interconnected by a connection tube (not shown), establishing the integrated type for the air buffer, similar to the type shown in FIG. 4, and providing an air flow.

Figure 6:
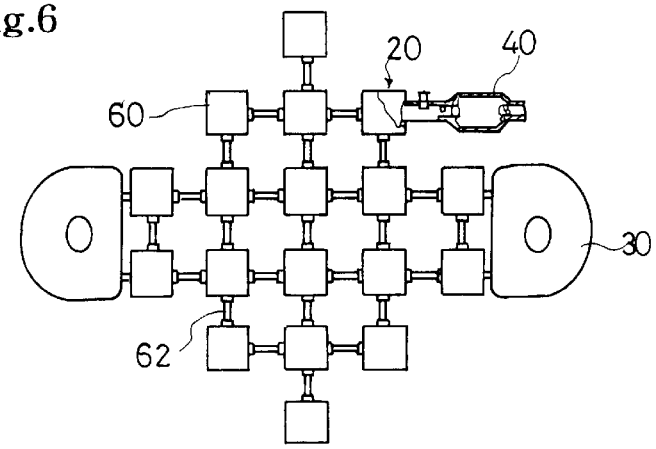
FIG. 6 is a plane view of the third preferred embodiment of the present invention.
Figure 9:
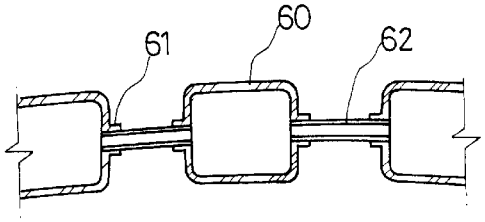
FIG. 9 is a detailed cross-section of the third preferred embodiment of the present invention.

In still another embodiment shown in FIG. 6 and FIG. 9, a plurality of air pockets 60, having a square or other shape, are interconnected to form an air buffer 20. The ventilation holes 61, at least two but not exceeding four, are formed in the walls of the air pockets 60. The connection tubes 62 are inserted into the ventilation holes 61, forming an integrated air buffer, wherein the air from the pump 40 flows between the air pockets 60 and the air guard 30, as shown in the description for the first embodiment.

Figure 10:
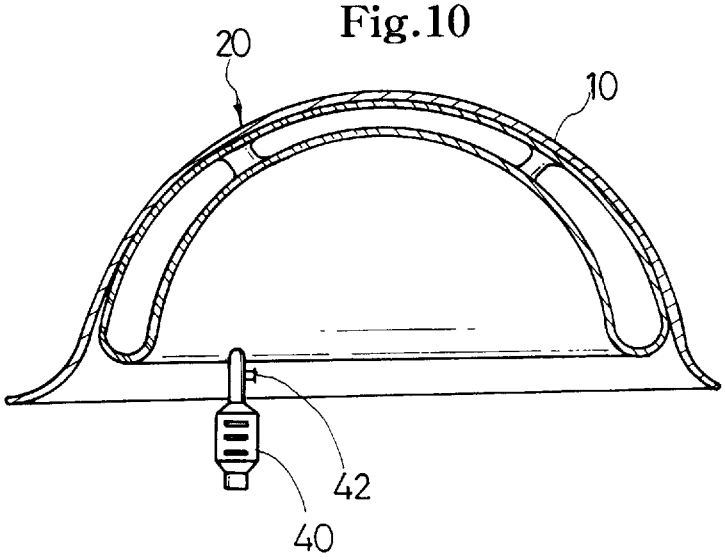
FIG. 10 is a cross-sectional view of another preferred embodiment of the present invention.

FIG. 10 shows another embodiment of a helmet with a fatigue cap not including an ear guard according to the present invention. The air buffer 20 is attached inside the outer shell 10 of a helmet, and a pump 40, equipped with an exhaust port 42, is installed on the helmet, thereby establishing the same effect as described above.

It will be apparent to those skilled in the art that various modifications and variations can be made in a helmet having a buffer air cushion of the present invention without deviating from the spirit or scope of the invention. Thus, it is intended that the present invention cover the modifications and variations of this invention provided they come within the scope of the appended claims and their equivalents.

I claim:

1. A helmet with a rigid shell, comprising:

an air cushion buffer having an inner wall contacting with a user's head, an outer wall contacting with an inner wall of the helmet shell, and a plurality of hollow cells;

an air ear guard having two walls forming a hollow chamber and a sound detection means;

a hollow air chin strap having ports connected to the air buffer;

means for inflating and deflating the air buffer, the ear guard and the air chin strap; and means for securing the outer wall of the air cushion buffer within the helmet shell.

2. The helmet as recited in claim 1, wherein the cells of the air buffer, the air guard and the chin strap are interconnected in order to provide an air flow.

3. The helmet as recited in claim 2, wherein the air buffer is made of soft foam resin, have a shape corresponding to the shape of the helmet shell and includes a ventilating means in its inner wall.

4. The helmet as recited in claim 2, wherein means for inflating and deflating includes a pump with an exhaust port connected to the air buffer and the ear guard.

* * * * *